US005446629A

United States Patent [19]

Steiger et al.

[11] Patent Number: 5,446,629

[45] Date of Patent: Aug. 29, 1995

[54] EMERGENCY LIGHT FIXTURE

[75] Inventors: Joseph Steiger, Wooddale, Ill.; Stephen Mulligan, Lake Wanda, N.J.

[73] Assignee: Omniglow Corporation, Novato, Calif.

[21] Appl. No.: 221,088

[22] Filed: Mar. 31, 1994

[51] Int. Cl.[6] ..... F21V 21/00; F21K 2/06

[52] U.S. Cl. ..... 362/34; 362/374; 362/254; 226/206

[58] Field of Search ..... 362/34, 253, 374, 375, 362/84, 154; 226/202, 206

[56] References Cited

U.S. PATENT DOCUMENTS 3,900,728 8/1975 Holcombe ..... 362/34
4,186,426 1/1980 Gingras, Sr. et al. ..... 362/34
4,193,109 3/1980 Heffernan et al. ..... 362/34
4,771,724 9/1988 Baretz et al. ..... 362/32 X

*Primary Examiner*—Ira S. Lazarus
*Assistant Examiner*—Thomas M. Sember
*Attorney, Agent, or Firm*—Majestic, Parsons, Siebert & Hsue

[57] ABSTRACT

This invention relates to a mounted emergency light fixture. The light fixture has a mount assembly and a front cover with a break plate which bends a light stick inserted into the fixture when the cover is pivoted from a closed position to an open position. The mount assembly has a restraining plate and a back side which maintain the light stick within the mount when the cover is pivoted to the open position. Hence, after the cover is opened the light sticks are illuminated and are held in the mount or may be removed to provide emergency lighting.

25 Claims, 3 Drawing Sheets

EMERGENCY LIGHT FIXTURE

BACKGROUND OF THE INVENTION

1. Field of the Invention

This invention relates to an emergency light fixture which is mounted on a wall or other surface to be easily illuminated by pulling down an outside cover of the fixture. The light fixture does not depend on an outside energy source such as electricity or other fuel, but relies only on a non-flammable chemical energy source, known as a light stick.

2. Description of Related Art

Chemiluminescent lighting devices or light sticks, as they are more commonly known, contain at least two sealed compartments. Each compartment contains one of two chemical components which, when admixed, react to produce chemical light. A device of this type is shown in U.S. Pat. No. 3,576,987, issued May 4, 1971. With this type of light stick, the compartments are defined by a sealed vial contained within a translucent outer body or shell. Only a single vial is required, as the outer shell or body contains the second chemical component. When the body is flexed enough to break the vial, which may be of a breakable material such as glass, the chemicals are released and mixed within the body. The chemical reaction that ensues produces light.

Another similar prior art light stick is shown in U.S. Pat. No. 4,508,642. With either of the prior art devices, they are generally tubular in shape with an open end for filling. The open end is sealed by means of a plug and the opposite end is closed. The opposite end may be closed by crimping or molding or other satisfactory means. The opposite end frequently includes an aperture for hanging or suspending the device from a horizontal support, such as a nail or line. The last-named patent shows a molded-in tip having an aperture therethrough.

Other than a single vial, some prior art devices utilize two vials. One such device which uses concentric vials is shown in U.S. Pat. No. 4,193,109, issued Mar. 11, 1980. Other constructions do not use a tubular outer shell. For example, U.S. Pat. No. 3,539,794 issued Nov. 10, 1970, shows the use of plastic pouches. Another construction of interest is found in U.S. Pat. No. 4,814,949 issued Mar. 21, 1989, wherein a shallow container has one or a plurality of glass vials therein. With the latter device, an absorbent material is used to spread the chemiluminescent compositions into a wider shape.

Such light sticks are often carried in vehicles to produce light in emergency situations on the road. When an emergency situation occurs, the light stick is retrieved from the trunk or other storage spot in the vehicle and is bent to produce light. The light stick is then used as a light source to warn oncoming traffic or to provide light to facilitate repair of the vehicle.

The same light sticks can be similarly used in an emergency situation in a home or other building. One disadvantage of using a light stick in this manner and in the above situations is that sometimes the light stick is difficult to locate. This difficulty is often experienced because in an emergency situation there can be insufficient lighting.

Additionally, in emergency situations, a person attempting to activate the light stick may not have full manual capacity or mental capacity for reasons attributed to the cause of the emergency. The present invention mitigates these problems.

SUMMARY OF THE INVENTION

The emergency light fixtures of the present invention include a mount assembly which may be mounted on any convenient, substantially planar surface such as a wall or the like, preferably at a previously selected, accessible location. Consequently, it is more likely that a potential user of the device will be able to find the light source in an emergency because the fixture is easily accessible and because the light is permanently mounted at a predetermined, consistent location. Moreover, the light source is readily activated by manipulating a front cover of the fixture which can be accomplished with one hand if desired or necessary.

According to the present invention, a light stick is supported in the mount assembly which is mounted on a substantially planar surface such as a wall or the like. The mount assembly which is structured and dimensioned to hold the light stick includes a back side, a base plate and a restraining plate opposite the back side. The front cover of the fixture is pivotally connected to the mount assembly so it can pivot from a closed position to an open position. Affixed to the inner or rear surface of the front cover is a break plate which operates in conjunction with the mount assembly to maintain the light stick in position within the fixture while the fixture is in the closed position and expedites bending of the light stick in order to break an internal container and release the necessary chemicals therefrom for mixture to produce light when the fixture is opened during an emergency or light failure condition.

In addition, at least one aperture is provided in the fixture through which the light stick is inserted into the fixture when the fixture is in a closed position. This aperture may be provided with a lid which is pivotally mounted on the fixture to allow for easy introduction of the light stick into the mounting assembly when the lid is open and to provide protection from external elements when the lid is closed.

Thus, in operation, a light stick is positioned in the fixture and is retained in position by the mounting assembly and the break plate of the cover while the device is in a closed position. Then, when the cover of the fixture is pivoted to the open position, the break plate engages the light stick and pulls it in the direction of pivot while the restraining plate and the back side maintain the light stick in the mount counter to the action of the break plate. The counter actions cause the light stick to bend and break an internal vial or like container to release chemicals contained therein to thereby activate illumination of the light stick.

Thus, when the cover is pivoted to a sufficient angular extent with respect to the plane of the back side of the mount assembly, the light stick will bend sufficiently to break the container and then, as the cover is further pivoted, the light stick slides out of engagement with the break plate. Accordingly, the cover is allowed to move to a fully open position, with the illuminated light stick remaining in the mount to provide light to the surroundings or the activated light sticks may be removed to provide a mobile light source. The activation procedure is easily performed; it is simply a matter of pulling down the cover.

Other objects, features, and advantages of the invention will become evident in light of the following Detailed Description considered in conjunction with the referenced drawings of a preferred exemplary embodiment according to the present invention.

BRIEF DESCRIPTION OF THE DRAWINGS

The following figures have been included to more clearly describe the present invention.

DESCRIPTION OF THE PREFERRED EMBODIMENT

Figure 1:
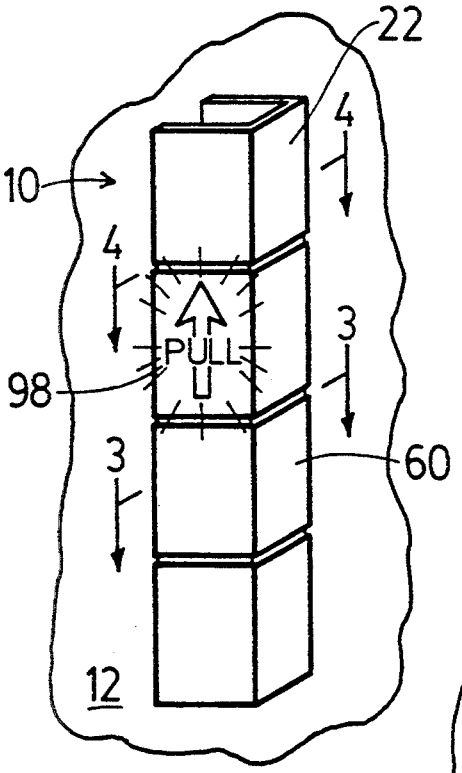
FIG. 1 is a perspective view of the emergency light fixture in a closed position.

The emergency light fixture 10 of the present invention is shown in FIG. 1 mounted on a mounting surface such as wall 12 in a closed position. The emergency light fixture 10 in the present invention is shown in a fully open position in FIG. 2. A preferred embodiment of the present light fixture for accommodating light sticks comprises two primary components: a mount assembly 20, and a front cover 22. The preferred embodiment is designed to hold two light sticks 24, 26, so the illumination upon activation has double the intensity.

Figure 6:
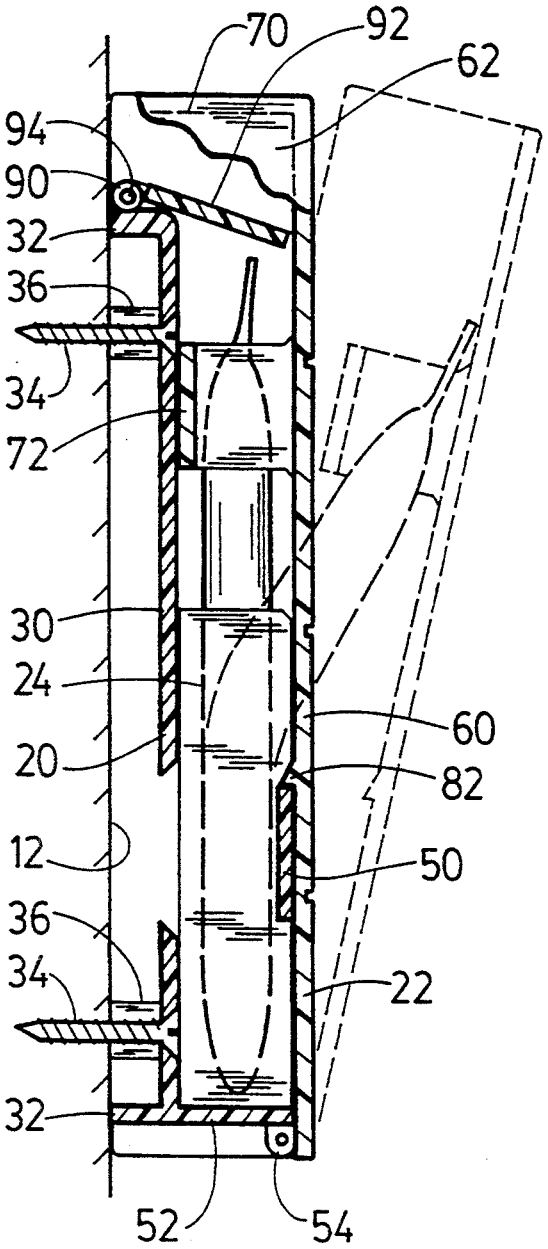
FIG. 6 is a break away side view of the emergency light fixture.
Figure 7:
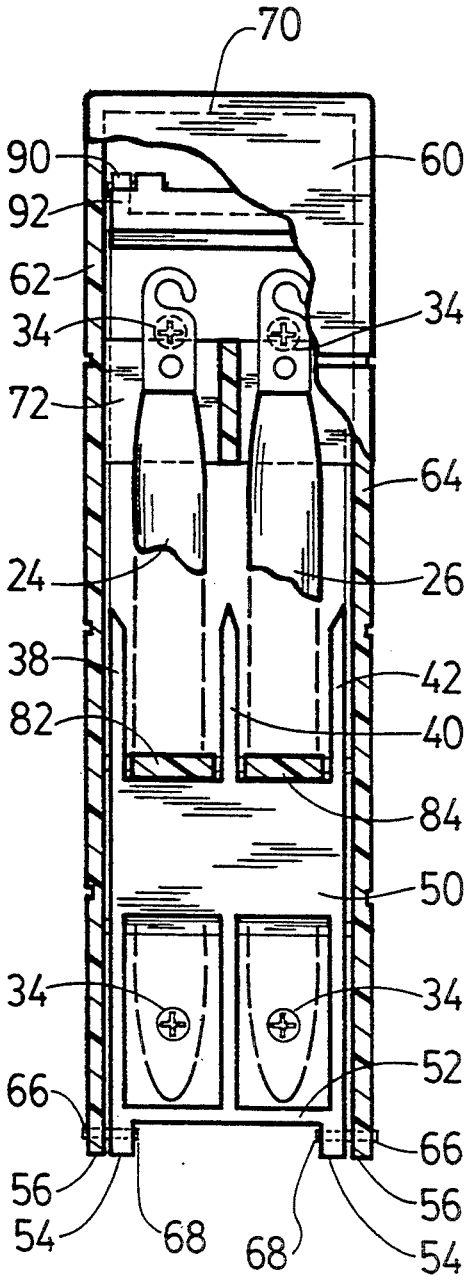
FIG. 7 is a break away elevational view of the emergency light fixture of the present invention.

However, it should be clear that arrangements can be provided to accommodate a single light stick or other multiples thereof. The mount assembly 20 has a rectangular, substantially flat or planar back side 30 which is offset from the wall 12 by a raised edge 32 best illustrated in FIGS. 4 and 6 which runs around a perimeter thereof. Four screws 34 through bosses 36 in the back side 30 secure the mount 20 to the wall 12 or other surface.

Figure 3:
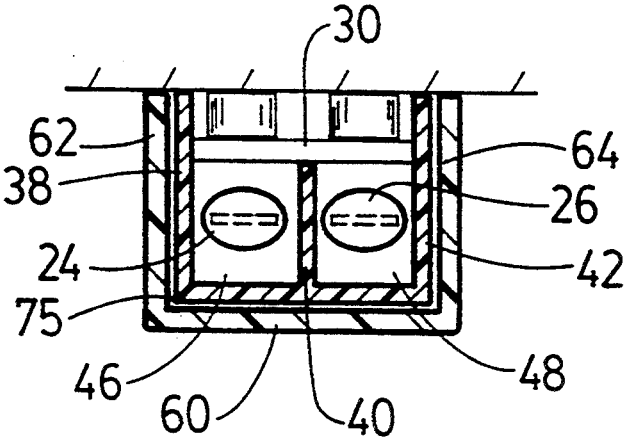
FIG. 3 is a cross sectional view taken along line 3—3 in FIG. 1.

Extending frontwardly from the back side 30 are three flanges, a left flange 38, a middle flange 40 and a right flange 42. The three flanges provide two chambers: a left base chamber 46 between the left flange 38 and middle flange 40 and a right base chamber 48 between the middle flange 40 and the right flange 42, as shown in FIG. 3. A restraining plate 50 is frontwardly fastened to the flanges 38, 40, 42 opposite the back side 30 of the mount 20. The restraining plate 50 traverses from the left flange 38 across the middle flange 40 to the right flange 42. A base plate 52 perpendicular to said back side 30 of the mount 20 traverses underneath the flanges 38, 40, 42. Two loops 54 descend from the base plate remote from the back side 50. Apertures 56 in the loops 54 are in a plane parallel to the flanges.

The cover 22 comprises three panels including a front panel 60, a left side panel 62 and a right side panel 64. The left panel 62 and right panel 64 extend rearwardly from the front panel 60. Two apertures 66 are defined through a bottom front corner of each of said left and right panels 62, 64. The apertures 66 on the left and right panels 62, 64 align with the apertures 56 in the loops 54 hanging from the base flange 52 of the mount 20. An elongated pin 68 is inserted through each pair of mating apertures 56, 66 to couple the cover 22 to the mount 20 and enable the cover 22 to pivot about the pins 68 with respect to the mount assembly 20. The left and right side panels 62, 64, respectively, and the front panel 60 are dimensioned sufficiently wide to envelope the entire mount assembly 20 and overly tall to provide a handle 70 at a top of the cover 22.

The fixture 10 is in a closed position when the cover 22 is upwardly pivoted to envelope the mount 20 as shown in FIG. 1. A break plate 72 is fastened within the cover 22 between the left and right side panels 62, 64 of the cover 22 and opposite the front panel 60. The break plate 72 traverses from the left panel 62 to the right panel 64 and is flush with the back side 30 of the mount 20 when the fixture 10 is in the fully closed position. The distance between the break plate 72 and the base plate 52 is greater than the distance between the restraining plate 50 and the base plate 52.

Figure 4:
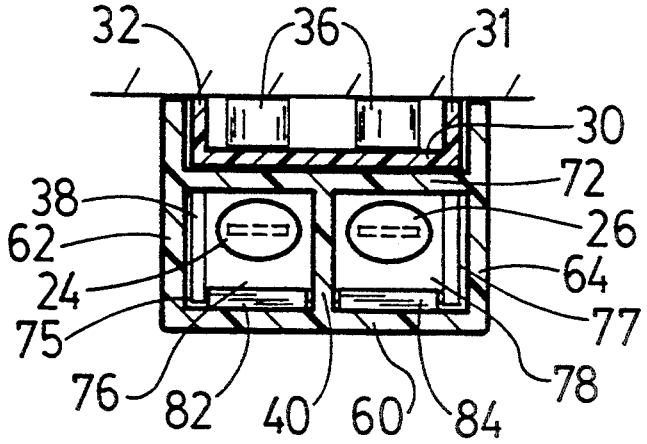
FIG. 4 is a cross sectional view taken along line 4—4 in FIG. 1.
Figure 5:
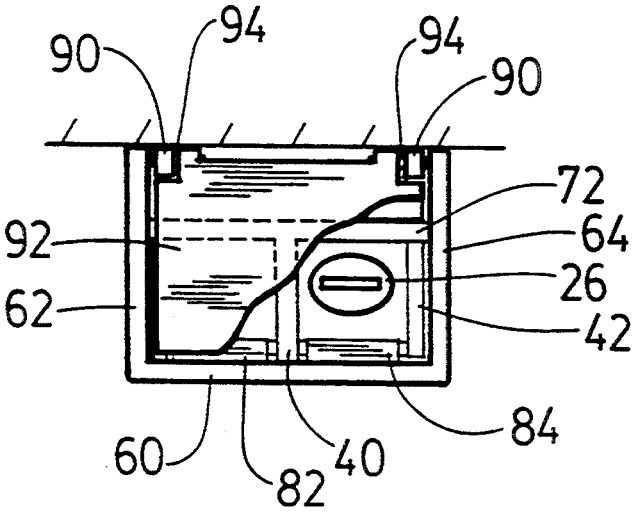
FIG. 5 is a break away top view of the emergency light fixture.

A partition equivalently divides the space constrained by the break plate 72, the left panel 62, the front panel 66 and the right panel 64 into two chambers: a left upper chamber 76 and a right upper chamber 78 as shown in FIG. 4. The left upper chamber 76 is in axial alignment with the left base chamber 46, and the right upper chamber 78 is in axial alignment with the right base chamber 48.

This configuration allows a first light stick 24 to be inserted down through an aperture 75 extending inwardly from the exterior of fixture 10 into the left upper chamber 76 and down through the left base chamber 46, and a second light stick 26 to be inserted through a companion aperture 77 extending inwardly from the exterior of fixture 10 into the right upper chamber 78 and down through the right base chamber 48 when the fixture 10 is in the closed position. The base plate 52 ensures that the light sticks 24, 26 will not fall through the light fixture 10.

The light sticks 24, 26 have a top and a bottom and comprise a tube filled with a mixture of chemicals which react together when mixed to produce a chemiluminescent substance when the tube is bent. The chemiluminescent substance emits light to provide illumination. Examples of suitable light stick products for use herein are the light sticks sold by Omniglow Corporation under the trademarks "Cyalume" and "Snaplight" and by Strato Flare Reflective Products, a Division of Cortina Tool & Molding Co. under the trademark "Strato Flare" Light Sticks. Further details concerning the construction and operation of chemiluminescent lighting devices may be found in U.S. Pat. Nos. 3,539,794; 3,576,987; 4,508,642; 4,193,109; 4,814,949 and 5,043,851; the subject matter of which patents are incorporated herein by reference.

When the emergency light fixture 10 is mounted on the wall 12 and placed in the closed position in accordance with the present invention, the light fixture 10 is activated by simply pivoting the cover 22 down and away from the mount 20 to an open position by use of the handle 70. When the cover 22 is pulled down, the break plate 72 engages the light sticks 24, 26 and causes the top of the light sticks 24, 26 to pivot with the cover 22. The restraining plate 50 restrains the light sticks 24, 26 from pivoting out of the fixture 10 and the back side 30 maintains the light sticks 24, 26 in the mount 20. Consequently, the break plate 72 bends the top of the light sticks 24, 26 about the restraining plate 50 at a bending point.

Therefore, the opening of the cover 22 bends the light sticks 24, 26 to break an internal container to activate illumination, but the restraining plate 50 coacting with the back side 30 holds the light sticks 24, 26 in the base chambers 46, 48. When the cover 22 is pivoted to an angle at which a radial distance between the break plate and the bending point exceeds a distance between a top edge of the light sticks 24, 26 and the bending point, the break plate 72 disengages the light sticks 24, 26 which slide out of the right and left upper chambers 76, 78, respectively. The illuminated light sticks 24, 26 remain in the left and right base chambers 46, 48, respectively. Thus, the light sticks 24, 26 are easily activated by simply pulling the cover 22 from the closed position to the open position. This can be achieved with little mental and physical capacity.

The preferred embodiment of the present invention has some additional features. Two protuberances 82, 84 with a right-triangular cross section extend rearwardly from an inside of the front plate of the cover. The base of the right triangles are positioned to engage a top of the restraining plate 50 when the emergency light fixture 10 is in the closed position. The engagement of the protuberances 82, 84 and the top of the restraining plate 50 contribute to hold the cover 20 in the closed position.

Also, two hooks 90 extend from the top of the mount and curve rearwardly away from the cover 22. A lid or dust plate 92 with two outwardly extending dowels 94 engage said hooks to pivotally couple the dust plate 92 to the mount 20. The lid 92 can be pivoted to a closed position in order to shield the light sticks 24, 26 inside the fixture 10 from ambient exposure or can be pivoted into an open position to expose apertures 75, 77 to enable insertion of the light sticks 24, 26, respectively, into the fixture 10.

Figure 2:
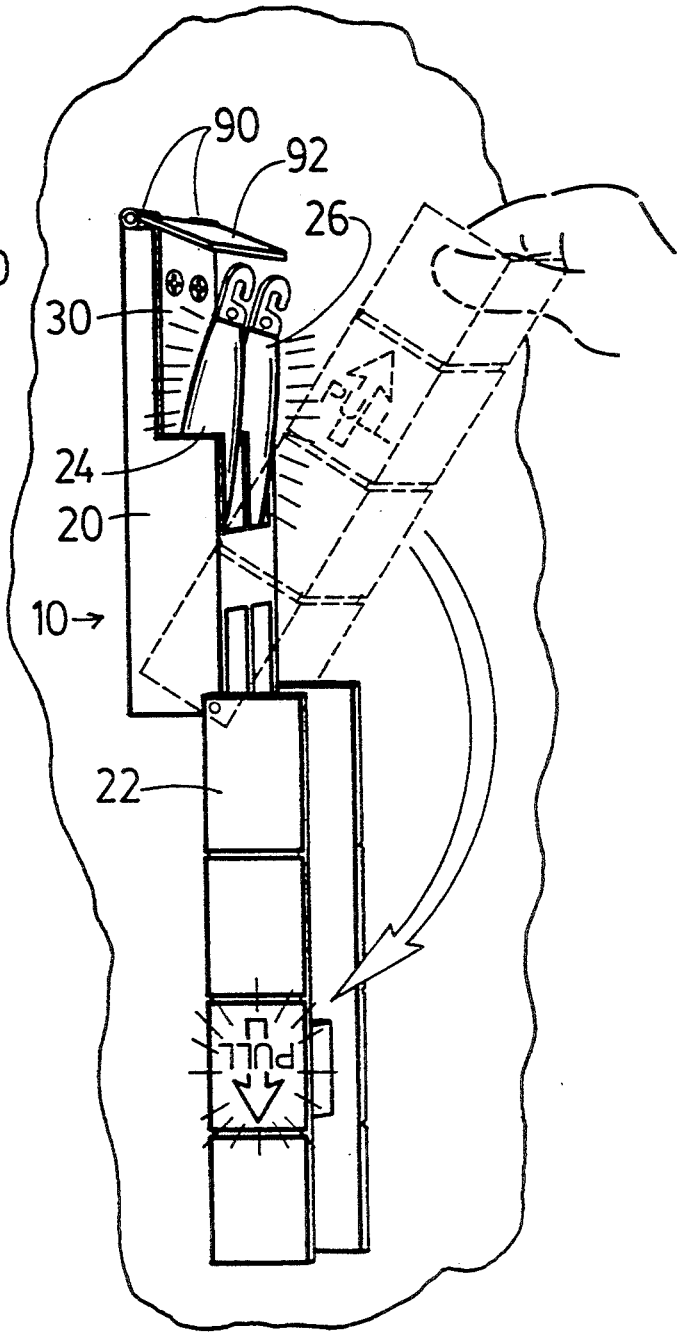
FIG. 2 is a perspective view of the emergency light fixture in a fully open position.

A fluorescent or photoluminescent decal 98 may be adhered to the outside of the cover and glows when there is a lack of external light. The decal 98 exhibits an instruction such as "PULL" and an arrow indicating to the user to pull down the cover to activate the emergency light fixture 10, as shown in FIGS. 1 and 2. In an emergency situation when the lighting in the building is out, the florescent or photoluminescent decal 98 will guide a person to the emergency light fixture and instruct the person to pull down the cover to activate the emergency light fixture 10.

Hence, an emergency light fixture has been disclosed comprising a mount assembly including a back side, two peripheral flanges extending frontwardly from the back side, a restraining plate which traverses the flanges opposite the back side, a base plate extending from the back side below said flanges and a means for securing said mount to a surface; a front cover including a front side and two peripheral sides extending rearwardly from the front side of the cover; means for coupling the cover to the mount to facilitate movement of the cover with respect to the mount from a closed position to an open position; a known chemiluminescent light stick having a top and a bottom, which illuminates upon sufficient bending of the stick, the stick being inserted into said fixture while the front cover is in the closed position; a break plate traversing the peripheral sides of the front cover opposite from the front side thereof which engages and bends the top of said light stick about the restraining plate when the cover is moved to an open position thereby causing necessary chemicals to be brought into reactive contact in order to illuminate the light stick.

Although the invention has been described in conjunction with the foregoing preferred embodiment, many alternatives, variations, and modifications will be apparent to those of ordinary skill in the art. Those alternatives, variations, and modifications are intended to fall within the scope of the following appended claims.

What is claimed is:

1. An emergency light fixture comprising, in combination:

a mount assembly including a back side, two peripheral flanges extending frontwardly from said back side and a restraining plate which traverses said flanges opposite from said back side;

a front cover including a front side and two peripheral sides extending rearwardly from said front side;

means for coupling said front cover to said mount assembly to facilitate the movement of said cover with respect to said mount from a closed position to an open position;

at least one chemiluminescent light stick having a top and a bottom, which illuminates upon bending, inserted into said fixture; and a break plate traversing said peripheral sides of said cover opposite said front side which engages and bends the top of said at least one light stick about said restraining plate when the front cover is pivoted to an open position thereby causing said at least one light stick to illuminate.

2. The fixture of claim 1 wherein said mount assembly includes a base plate extending from said back side below said flanges.

3. The fixture of claim 1 including means for securing said mount assembly to a surface.

4. The fixture of claim 1 including means for inserting said at least one chemiluminescent light stick into said fixture while said cover is in a closed position.

5. The fixture of claim 1 having a handle for pulling the cover from a closed position to an open position.

6. The fixture of claim 5 wherein said peripheral sides and said front side of said cover extend above the back side and the peripheral flanges of said mount assembly to provide said handle.

7. The fixture of claim 1 wherein the mount assembly includes a lid pivotally coupled thereto to allow insertion of said light stick into said fixture while said fixture is in a closed position and preventing exposure of the light sticks to ambient conditions.

8. The fixture of claim 1 including a decal with an instruction indicating the activation of said fixture and an element which glows in dark surroundings to signal the location of the fixture.

9. The fixture of claim 1 wherein the cover has protuberances on an interior thereof for engaging the restraining plate of the mount assembly when the cover is in a closed position.

10. The fixture of claim 1 wherein the mount assembly and the cover are provided with partitions for accommodating a plurality of light sticks in isolation from each other.

11. The fixture of claim 2 wherein the means for coupling said cover to said mount assembly is a pivotal coupling which facilitates pivotal movement of said cover with respect to said mount assembly.

12. The fixture of claim 11 wherein the coupling means is located at said base plate.

13. The fixture of claim 1 wherein the restraining plate is structured and dimensioned sufficiently close to said back side of said mount assembly to prevent said at least one chemiluminescent light stick from exiting the fixture when the cover is pivoted to the open position.

14. An emergency light fixture comprising:

a mount assembly including a back side, two peripheral flanges extending frontwardly from said back side, and a restraining plate which traverses said flanges opposite said back side;

a front cover including a front side and two peripheral sides extending rearwardly from said front side;

means for coupling said front cover to said mount assembly to facilitate the movement of said cover with respect to said mount from a closed position to an open position;

a break plate traversing said peripheral sides of said front cover opposite said front side;

said restraining plate and said break plate being aligned to receive at least one light stick inserted into said fixture and being structured and dimensioned to engage and bend said light stick about said restraining plate when the front cover is opened thereby causing said light stick to illuminate.

15. The fixture of claim 14 wherein said mount assembly includes a base plate extending from said back side below said flanges.

16. The fixture of claim 14 including means for securing said mount assembly to a surface.

17. The fixture of claim 14 including means for inserting said at least one light stick into said fixture while said cover is in a closed position.

18. The fixture of claim 14 including a decal with an instruction indicating the activation of said fixture and an element which glows in dark surroundings to signal the location of the fixture.

19. The fixture of claim 14 wherein the cover has protuberances on an interior thereof for engaging the restraining plate of the mount assembly when the cover is in a closed position.

20. The fixture of claim 14 wherein the mount assembly and the cover are provided with partitions for accommodating a plurality of light sticks in isolation from each other.

21. The fixture of claim 14 wherein the means for coupling said cover to said mount assembly is a pivotal coupling which facilitates pivotal movement of said cover with respect to said mount.

22. The fixture of claim 14 wherein the restraining plate is structured and dimensioned sufficiently close to said back side of said mount assembly to prevent a light stick inserted in said fixture from exiting the fixture when the cover is pivoted to the open position.

23. A light stick activation device comprising:

mount assembly means for holding at least one light stick in a stored position until ready for activation, and cover means surrounding at least a portion of said light stick, said cover means in operable engagement with said mount assembly means, structured and dimensioned to enable activation of said light stick upon movement of said cover, said device further including pivot means intermediate said mount assembly means and said cover means whereby said cover means may be pivoted with respect to said mount assembly thereby bending the light stick for activation thereof.

24. The device of claim 23 wherein said cover means operates to bend the light stick for activation thereof.

25. The device of claim 23 wherein said mount assembly means includes a restraining plate for restraining movement of the light stick, and wherein said cover means includes a break plate dimensioned and positioned so as to force the light stick against said restraining plate when said cover means is pivoted away from said mount assembly means thereby effecting bending of the light stick for activation thereof.

* * * * *